United States Patent [19]

Becker et al.

[11] 4,414,054

[45] Nov. 8, 1983

[54] PORTABLE LABELING MACHINE

[75] Inventors: Werner Becker, Hirschhorn; Heinz Kistner, Neckarsteinach, both of Fed. Rep. of Germany

[73] Assignee: Esselte Pendaflex Corporation, Garden City, N.Y.

[21] Appl. No.: 394,523

[22] Filed: Jul. 2, 1982

[30] Foreign Application Priority Data

Feb. 18, 1982 [CH] Switzerland ..... 1008/82

[51] Int. Cl.[3] ..... B65C 11/02

[52] U.S. Cl. ..... 156/384; 101/288; 156/577; 156/579; 156/584; 156/DIG. 33; 156/DIG. 49

[58] Field of Search ..... 156/384, 574, 577, 579, 156/584, 541, DIG. 33, DIG. 48, DIG. 49; 101/288

[56] References Cited

U.S. PATENT DOCUMENTS 4,026,758 5/1977 Sato ..... 156/579
4,382,835 5/1983 Sato et al. ..... 156/384

FOREIGN PATENT DOCUMENTS 2460444 6/1976 Fed. Rep. of Germany ..... 156/384
2050034 3/1971 France .
WO79/01109 12/1979 PCT Int'l Appl. .

*Primary Examiner*—Michael G. Wityshyn
*Attorney, Agent, or Firm*—Hedman, Casella, Gibson, Costigan and Hoare

[57] ABSTRACT

The machine is intended for the printing of selected characters on self-adhesive labels (5) forming a continuous series borne by a support strip (8).

The inner circuit of this strip passes via a loop defined by an edge (11) at the level of which each label (5), after printing, is advanced by a step corresponding to its length, is separated from the support strip, and is directed below a pressure roller (12) in order to be glued by pressure onto an article to be labeled.

In order to prevent the falling of the printed label before its gluing and in order to present it flat below the pressure roller (12) there are provided a cambering device which comprises two guides (20, 21) between which the label is stiffened by cambering in the direction of its displacement and the pressure roller itself, under which the edges of the label which have been raised by the cambering are brought downward.

6 Claims, 5 Drawing Figures

PORTABLE LABELING MACHINE

The object of the present invention is a portable labeling machine for printing selected characters on labels and gluing the labels onto articles intended for sale.

Certain known machines which are suitable for this function comprise, like the machine of the invention, a housing provided with a grasping handle, a control lever located below the handle, a printing device connected to the lever for printing upon each pull thereof selected characters onto a label of a continuous strip formed of a series of self-adhesive labels borne by a common support strip, a device for driving said continuous strip step-by-step which is also connected to the control lever so as to cause, upon each release of the lever, the advance of the said continuous strip by a step corresponding to the length of one label along an inner circuit comprising a hairpin curve which forms a separating edge after which each printed label is separated at least in part from the support strip and placed below a pressure roller supported by the housing, towards the outside of the latter, to permit its attachment by gluing pressure onto the article to be labeled, and in which there is provided a device for the cambering of said label which is adapted to hold it so as to prevent it from falling after its separation from the support strip and before its pressure gluing.

On the label-bearing support strip, which is generally formed of a ribbon with a glossy or waxed surface, the labels form a continuous sequence, each separated from the preceding one by a cutting line the depth of which must be sufficiently precise both to preserve the existence of a "glue bridge" which participates in the holding thereof before gluing and to facilitate its tearing off after gluing.

In the known machines which are not provided with a device for holding the printed label, the adjustment of the advancing step is such that at the end of its exit stroke the label is still held by its rear end while its front portion is below the pressure roller, so as to prevent it from swinging around the distribution edge and not coming below the pressure roller. As a result, it may happen on these machines that, as a result of too deep a cut which eliminates the glue bridge connecting it to the following label and therefore of a shift of the advancing step having the effect of freeing it completely from the support strip, the printed label is detached and falls off before the operator has had the time or opportunity to glue it.

On the known machines provided with a cambering device which is intended to avoid this drawback which results in a loss of time and irritation, this device is formed by the combination of a longitudinal direction-change guide which covers the separating edge with a bearing roller located below this guide. This combination has the function of cambering the label around the bearing roller, perpendicular to the direction of its displacement, upon its emergence from the separating edge. Even though detached from the support strip and from the following label, the printed label is thus held between the guide and the bearing roller by its own elasticity. However, this design requires the addition of an exit spout so as to prevent the escaping of the label towards the rear by swinging around the bearing roller, and the length of the guide as well as its degree of curvature must be adapted in each case to the different lengths of labels used in order to be certain to obtain the desired effect. This last-mentioned restriction prevents in practice the use of labels of different lengths on the same labeling machines.

A label guide device, described in French Patent 2 050 034, which is especially designed for labels of great length is already known. This device is installed at the outlet from the separating edge of a labeling machine for a different purpose, namely to prevent the long label from sagging and hanging by its own weight. This device is formed of elements which are arranged opposite each other on the two sides of the label and are intended to curve the label in a direction perpendicular to its plane, that is to say actually to camber it in the direction of its length in order thus artificially to impart to it a rigidity which it does not inherently have in this direction.

A cambering which is effected in this manner may be of small amplitude in order sufficiently to stiffen the label, but it cannot, without drawback, itself assure the holding of a label which has been detached from its support strip before its attachment so as to solve the aforementioned problem raised by the known portable labeling machines of the same type as the invention. For this, it would be necessary to impart the longitudinal camber thus produced a substantial amplitude, which is incompatible with the system of attachment by means of a pressure roller. In fact, upon attachment by the pressure of this roller, the label, since it is cambered, may be wrinkled or crumpled or else be shifted transversely below this roller before the final impact, which would be prejudicial to the sharpness of the inscriptions and the precision of the positioning.

The object of the invention is to securely hold a label which has been detached from its support strip before its attachment by a manner of cambering which is free of the aforementioned drawbacks.

For this purpose, the portable labeling machine of the invention is characterized by the fact that its device for cambering of the printed label comprises three elements, one of which is the pressure roller itself and the other two are two cambering guides which extend transversely and opposite each other, one above and the other below the exit path of the printed label, which guides have complementary camber profiles and form between them the envelope of an imposed curvilinear passage of a height and width which are greater than the thickness and width respectively of the labels, said passage having a flared entry and being arranged between the pressure roller and the separating edge so as to camber the label parallel to the direction of its displacement and on the side opposite to the pressure roller, and by the fact that the generatrix of the contact of this pressure roller with the label is located no higher than the level of a plane tangent to the cambered portion of this label.

In this way, upon its exit from the separating edge the printed label is first of all progressively cambered in the imposed passage formed by the two cambering guides and then, upon its arrival in contact with the pressure roller, its two edges which have been lifted by the cambering thus produced are progressively pushed back by this roller until the portion thereof located directly below the said roller is flattened due to the fact that the longitudinal orientation of the camber prevents the label from swinging between the two guides. These two combined actions generate two spaced, opposing elastic pressure forces applied by the forces of reaction of the label both on the cambering guides and on the pressure roller. In case of premature detachment of the printed label, the latter is held in the form of a bridge by pressure both on the pressure roller and on the two cambering guides. The effectiveness of this holding is independent of the resistance to the advance of the label between the cambering guides, which may therefore be limited to a minimum as a function of the rigidity of the labels used. On the other hand, the flattening of the printed label below the pressure roller places the label in the best condition to assure the precision of its attachment and to avoid the formation of transverse wrinkling or crumpling at the time of the gluing impact on the article to be labeled. Finally, this cambering device can be applied to all customary lengths of labels suitable for this type of machine.

The accompanying drawing shows one embodiment of the object of the invention, given by way of example.

Figure 1:
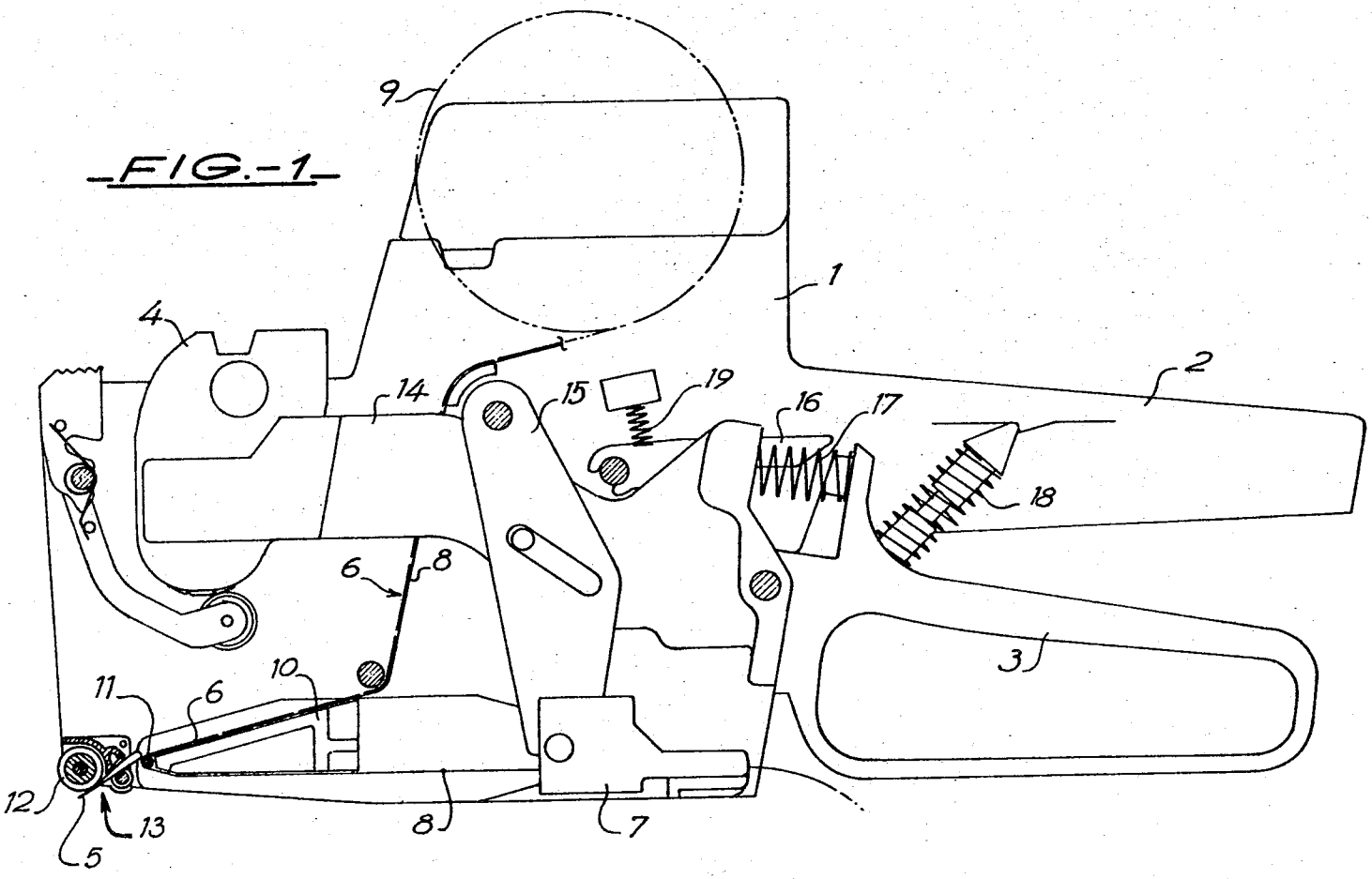
FIG. 1 is an overall view thereof in longitudinal section.

The portable labeling machine shown as a whole in FIG. 1 comprises a housing 1 provided with a grasping handle 2, with control lever 3 connected on the one hand to a printing device 4 intended to print selected characters on a label of a continuous strip 6 of labels upon each pull on the control lever 3 and, on the other hand, to a device 7 for the driving of the continuous strip 6 step-by-step in order to advance it by a step corresponding to the length of one label upon each release of the control lever 3.

The continuous strip of labels 6 is formed, as customary, by a series of self-adhesive labels borne by a glossy or waxed support strip 8, coming from a roll 9 provided in the upper portion of the housing 1.

The circuit of the continuous strip of labels 6 passes over a printing table 10 located opposite the printing device 4 on which selected characters are printed on a label and at the end of which this circuit forms a hairpin contour defined by a separating edge 11.

At the level of this edge 11 the printed label 5 whose rigidity is greater than that of the support strip 8 gradually detaches itself as it advances and is directed below a pressure roller 12 borne by the housing 1 towards the outside of the latter so as to be glued by pressure of the machine onto the article to be labeled, passing through the cambering device 13 which characterizes the invention and will be described further below.

Below the printing table 10, the support strip 8, freed of its labels, is engaged in the drive device 7 which is imparted a reciprocating motion upon each release by pressure of the control lever 3 and behind which this support strip 8 is ejected towards the outside.

The printing and withdrawal movements of the printing device 4 and the reciprocating movement of the drive device 7 are obtained by a mechanism with levers, 14, 15, 16 and cocking spring 17 and return springs 18 and 19, which is of the conventional assisted-drive type with uniform pressure.

Figure 2:
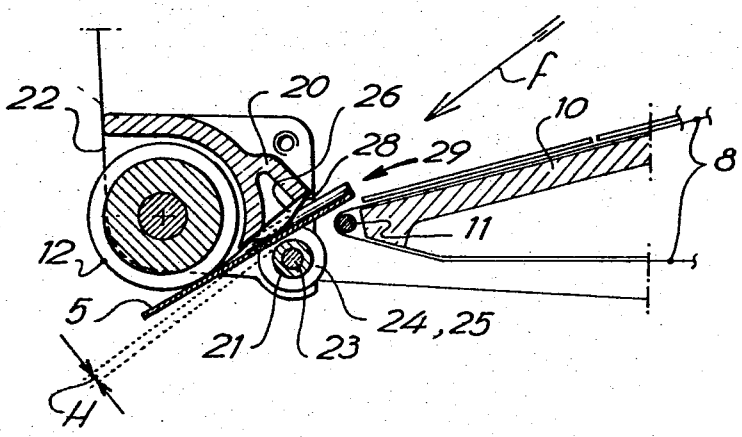
FIG. 2 is an enlarged detail view of FIG. 1.
Figure 3:
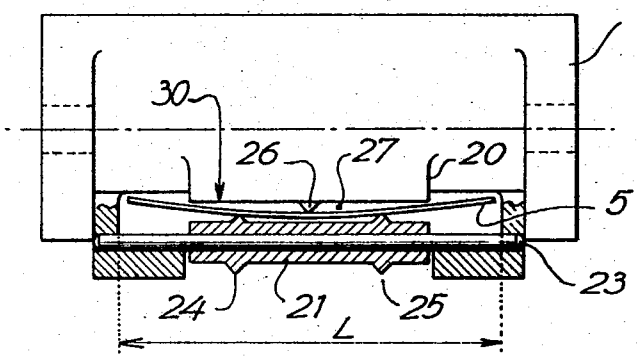
FIG. 3 is a view in the direction indicated by the arrow f in FIG. 2, seen in partial section.

The cambering device 13 for the printed label 5, shown in detail in FIGS. 2 and 3, is intended to prevent the label from falling before gluing in case of the rupture of its attachments to the following label and/or the support strip 8 which have been described at the beginning hereof and it comprises three elements, one of which is formed of the pressure roller 12 itself and the other two by two cambering guides 20 and 21 extending transversely and opposite each other, one of them, 20, above and the other, 21, below its exit path, between the separating edge 11 and the pressure roller 12.

The fixed upper guide 20 is part of the structure of a support 22 in which the pressure roller 12 is mounted, and the lower rotary guide 21 is formed of a cylinder mounted on a shaft 23 borne by this support.

These two guides have complementary camber profiles the relief of which is formed here by three guide ribs 24, 25 and 26, the first two of which 24, 25 having the shape of toroids of revolution are borne by the lower cylindrical guide 21 and the third 26 of which is borne by the upper guide 20, midway between the first two 24 and 25.

These two camber profiles constituted in this way form between them the envelope of a curved imposed passage 27 of height H and width L which are greater than the thickness and width respectively of the label 5, so as to present minimal resistance to the passage of the label.

The rotary mounting of the lower guide 21 which bears the first two ribs 24 and 25 also contributes to reducing this resistance.

Finally, the rib 26 of the upper guide 20 has an inclined edge 28 so as to create, in combination with the shape as body revolution of the first two ribs 24 and 25 of the lower rotary guide, a flared entry 29 which has the effect of making the formation of the camber of the label progressive as well as of centering the label on the entry of the imposed passage.

From an examination of these two FIGS. 2 and 3 it is readily seen that the printed label 5, once cambered in the imposed passage between the guides 20 and 21 and once detached from the support strip 8, cannot swing downward because its own elasticity holds it pressed against the ribs of the guides and because the orientation of its camber, extending in the direction of its length, prevents its bending around the lower guide 21.

Figure 5:
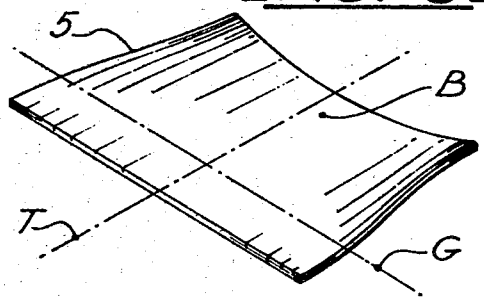
FIG. 5 is a detail of FIG. 3, shown in perspective.
Figure 4:
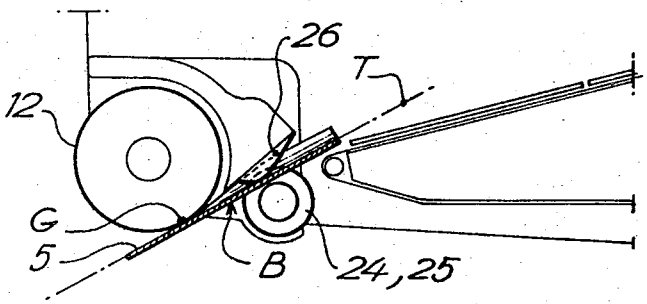
FIG. 4 is a diagram illustrating a particular point of the teaching of the invention.

As compared with the position in space of the two cambering guides 20 and 21, which has the effect of orienting the cambered label in a given direction around which it cannot swing by itself, the pressure roller 12 is arranged in such a manner as to be substantially tangent to said direction, that is to say, as shown in FIGS. 4 and 5, in such a manner that its generatrix G of contact with the label 5 is substantially at the level of a plane T tangent to the cambered part B of said label.

In this way, when the label arrives in contact with the pressure roller 12 its two raised edges are gradually pushed back downward, by counter-bending, substantially to the level of the cambered portion B, the action of the cambering guides 20 and 21 preventing the swinging of the label.

The two opposing actions already described are thus applied to the printed label 5, they having the effect both of holding it in a bridge by pressure on the two cambering guides 20 and 21 and the pressure roller 12 and of presenting it under the best conditions below the pressure roller, that is to say flattened at this level.

According to the greater or lesser elasticity of the label, the pressure roller 12 will be lowered to a greater or lesser extent with respect to the aforementioned plane T so as to assure the flattening of the label. As a result, the relative position of the pressure roller with respect to the label shown in the drawing constitutes the upper limit above which the flattening of the label can no longer be assured.

With respect to the opposition to swinging of the label provided by the guides 20 and 21, this opposition may be increased by the structure itself of the support 22. For this purpose the bearing structure 30 of the guide 20, from which the guide rib 26 projects in the form of a flat wall inclined substantially in the direction of said rib, may be extended over a portion of the width of the label up to the rear limit of said rib, on the side toward the separating edge 11, as furthermore shown in the drawing, so that the raised edges of the label come into contact with this bearing structure 30 when the required flattening force is greater than the retaining force exerted by the ribs 24, 25 and 26 alone.

The mounting of the pressure roller 12 and of the two cambering guides 20 and 21 in a common support 22 is advantageous in view of the fact that in this way one can provide different mountings which are precisely preadjusted as a function of the different mechanical characteristics of the labels used, but this type of mounting is not indispensable. The two guides 20 and 21 may be mounted separately from the pressure roller 12.

The cambering profiles of the two guides may be obtained, in variants, by fixed curved walls or else by solids of revolution with curved generatricies, mounted for rotation in the same manner as the lower guide 21, or else by the combination of a fixed curved wall with a rotary cylinder having curved generatricies.

The cambering may be multiple depending on the number of inflections imparted to the cambering profiles of the two guides. In particular, in the example shown, the number of ribs will be increased when this effect is desired.

What is claimed is:

1. A portable labeling machine comprising a housing (1) provided with a grasping handle (2), a control lever (3) located below the handle, a printing device (4) connected to the lever for printing, upon each pull on the lever, selected characters onto a label of a continuous strip (6) formed of a series of self-adhesive labels (5) borne by a common support strip (8), a device (7) for the step-by-step driving of the said continuous strip, which device is also connected to the control lever so as, upon each release of the latter, to cause the advance of said continuous strip by a step corresponding to the length of one label along an inner circuit comprising a hairpin curve which forms a separating edge (11), whereupon each printed label is separated, at least in part, from the support strip and placed below a pressure roller (12) borne by the housing, towards the outside of the latter, to permits its attachment by gluing pressure onto the article to be labeled, and in which there is provided a device for the cambering of said label, intended to maintain it so as to prevent the falling thereof after its separation from the support strip and before its pressure gluing, characterized by the fact that the label cambering device comprises three elements one of which is formed of the pressure roller (12) itself and the other two by two cambering guides (20, 21) extending transversely opposite each other, one above and one below the exit path of the printed label, which guides have complementary camber profiles and between them form the envelope of an imposed curvilinear passage (27) of a height (H) and width (L) which are greater than the thickness and width respectively of the labels, said passage having a flared entry (29) and being arranged between the pressure roller (12) and the separating edge (11) in order to camber the label parallel to the direction of its displacement and towards the side opposite the pressure roller, and by the fact that the generatrix (G) of contact of this pressure roller with the label is located at the highest at the level of a plane (T) tangent to the cambered portion (B) of the label.

2. A machine according to claim 1, characterized by the fact that the camber profiles of the two cambering guides are formed by at least three ribs (24, 25, 26), the first two of which (24, 25) are borne by one of the guides (21) and the third of which (26) is borne by the other guide (20) midway between the first two ribs.

3. A machine according to claim 2, characterized by the fact that one of the two cambering guides is formed of a rotary cylinder (21) comprising the first two cambering ribs (24, 25) and by the fact that the said ribs are formed by two toroids of revolution.

4. A machine according to claim 3, characterized by the fact that the third rib (26) borne by the cambering guide opposite the one bearing the first two ribs is stationary and has an inclined edge (28) directed towards the separating edge (11) and forming with these two first ribs (24, 25) the flared entry of the imposed passage.

5. A machine according to claim 4, characterized by the fact that the third guide rib (26) protrudes from a bearing structure (30) in the form of a flat wall extending over at least a portion of the width of the label and up to the rear limit of said rib in the direction of the separating edge (11).

6. A machine according to claim 1, characterized by the fact that the three elements of the cambering device (12, 20, 21) are mounted in a common support (22) fastened to the housing of the machine.

* * * * *